US009279557B2

(12) United States Patent
Su

(10) Patent No.: US 9,279,557 B2
(45) Date of Patent: Mar. 8, 2016

(54) LED LIGHTING BALL STRUCTURE

(71) Applicant: Prosperity JS Enterprise Company, Kaohsiung (TW)

(72) Inventor: Douglas Su, Kaohsiung (TW)

(73) Assignee: PROSPERITY JS ENTERPRISE COMPANY, Kaohsiung (TW)

( * ) Notice: Subject to any disclaimer, the term of this patent is extended or adjusted under 35 U.S.C. 154(b) by 0 days.

(21) Appl. No.: 14/487,434

(22) Filed: Sep. 16, 2014

(65) Prior Publication Data

US 2015/0211706 A1 Jul. 30, 2015

(30) Foreign Application Priority Data

Jan. 27, 2014 (TW) ..... 103102906 A

(51) Int. Cl.

| | |
|---|---|
| ***F21V 3/02*** | (2006.01) |
| ***F21V 23/00*** | (2015.01) |
| ***F21V 23/04*** | (2006.01) |
| *F21Y 101/02* | (2006.01) |
| *F21W 121/00* | (2006.01) |
| *F21Y 111/00* | (2006.01) |

(52) U.S. Cl.

CPC ..... *F21V 3/02* (2013.01); *F21V 23/009* (2013.01); *F21V 23/04* (2013.01); *F21W 2121/00* (2013.01); *F21Y 2101/02* (2013.01); *F21Y 2111/004* (2013.01)

(58) Field of Classification Search

CPC ..... A63H 2027/1058; A63H 2207/00; A63H 37/0003; A63H 59/06; F21V 3/02; F21V 23/009; F21V 23/04; F21Y 2101/02; F21Y 2111/004; F21W 2121/004

USPC ..... 362/216, 806, 809, 234, 253; 446/219

See application file for complete search history.

(56) References Cited

U.S. PATENT DOCUMENTS

| | | | | | |
|---|---|---|---|---|---|
| 3,011,048 | A * | 11/1961 | O'Brien | A63B 43/06 | 362/208 |
| 3,304,651 | A * | 2/1967 | Deyerl | A63B 43/06 | 200/61.47 |
| 3,804,411 | A * | 4/1974 | Hendry | A63B 43/06 | 273/DIG. 24 |
| 5,324,224 | A * | 6/1994 | Anderson | A63H 33/26 | 362/184 |

(Continued)

*Primary Examiner* — Laura Tso

(74) *Attorney, Agent, or Firm* — Muncy, Geissler, Olds & Lowe, P.C.

(57) ABSTRACT

An LED lighting ball structure includes a spherical shell, a control unit and a plurality of LED lighting units. The spherical shell includes a first segment and a second segment coupled with the first segment to jointly define a housing space. The first segment includes a first housing portion and a first decorative cover plate coupled with the first housing portion. The first housing portion includes a plurality of first assembly holes communicating with the housing space. The second segment includes a second housing portion and a second decorative cover plate coupled with the second housing portion. The second housing portion includes a plurality of second assembly holes communicating with the housing space. The control unit is located in the housing space. The LED lighting units are located in the first and second assembly holes respectively and form electrical connection with the control unit.

10 Claims, 7 Drawing Sheets

(56) References Cited

U.S. PATENT DOCUMENTS 5,772,312 A * 6/1998 Pihl-Niederman et al. ..... A47G 33/06 362/238
6,155,700 A * 12/2000 Hsu ..... F21V 23/04 362/196
7,384,172 B1 * 6/2008 Desfosses ..... F21S 6/002 362/282
8,727,918 B1 * 5/2014 Gentile ..... A63B 43/06 473/570
2002/0137582 A1 * 9/2002 Yu ..... A63B 43/00 473/570
2005/0057930 A1 * 3/2005 Heng ..... A47G 33/08 362/253
2012/0270685 A1 * 10/2012 Lindsey ..... A63B 43/06 473/422

* cited by examiner

LED LIGHTING BALL STRUCTURE

FIELD OF THE INVENTION

The present invention relates to an LED lighting ball structure and particularly to an LED lighting ball structure capable of enhancing visual effect.

BACKGROUND OF THE INVENTION

The general fans watching ballgames onsite mostly want to catch balls hit by the players, especially the balls that break records or have special meanings. They also want to get the balls signed by the players to make the balls to become collectibles, mementos and valuables. Many fans of the ballgames display the signature balls in the house as decorative items to show off their pride and collection desire.

For the record-breaking balls or those which have special meaning, ballgame players often try to keep for themselves, and offer non-regular balls to substitute the signatures to be collected by the fans as a win-win choice. But such memento balls could lose their value in the event that the ballgame players have suffered significant negative publication or undesirable game records. If such occasions take place the signature balls could lose their value and be thrown away. Moreover, the conventional signature balls are not regular balls and cannot be recycled and used again, hence also create environmental conservation concerns.

SUMMARY OF THE INVENTION

The primary object of the present invention is to provide an LED lighting ball structure projected by a plurality of LED lighting units to get flicker effect on the ball to enhance added values of the ball in ornament or display.

To achieve the foregoing object the LED lighting ball structure according to the invention includes a spherical shell, a control unit and a plurality of LED lighting units. The spherical shell includes a first segment and a second segment coupled with the first segment to jointly define a housing space. The first segment includes a first housing portion and a first decorative cover plate coupled with the first housing portion. The first housing portion includes a plurality of first assembly holes communicating with the housing space. The second segment includes a second housing portion and a second decorative cover plate coupled with the second housing portion. The second housing portion includes a plurality of second assembly holes communicating with the housing space. The control unit is located in the housing space. The LED lighting units are located in the first and second assembly holes respectively and form electrical connection with the control unit.

Through the LED lighting ball structure of the invention many advantages can be accomplished, notably:

1. In the LED lighting ball structure of the invention the LED lighting units can provide flicker alteration to enhance visual effect and collection and decorative value.

2. The invention also provides a power supply unit which can provide charging through a connecting portion to be used repeatedly, therefore can reduce environmental contamination.

3. The spherical shell of the invention can be covered by a coating layer to collaborate with different use modes and profiles to suit sales at the ballgame sites and player's signature to enhance the memento value, collectible feature and lasting value of the ball.

4. The ball according to the invention also can include a counterweight member inside to be proximate to the weight of a real ball to improve authenticity.

The foregoing, as well as additional objects, features and advantages of the invention will be more readily apparent from the following detailed description, which proceeds with reference to the accompanying drawings. It is to be noted that like elements are designated with like numerals.

DETAILED DESCRIPTION OF THE PREFERRED EMBODIMENTS

Figure 1:
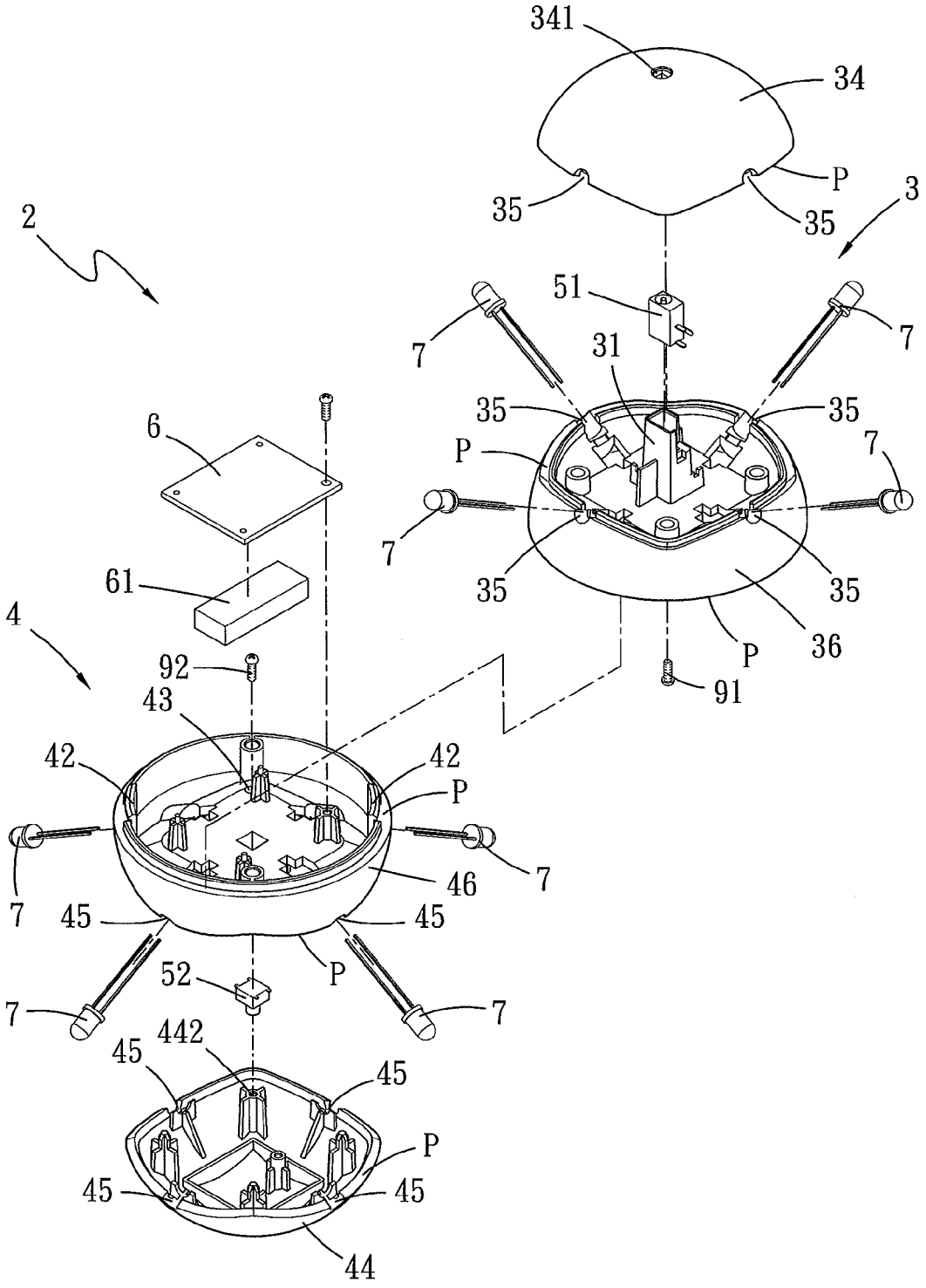
FIG. 1 is an exploded view of the LED lighting ball structure of the invention viewed from the top.
Figure 2:
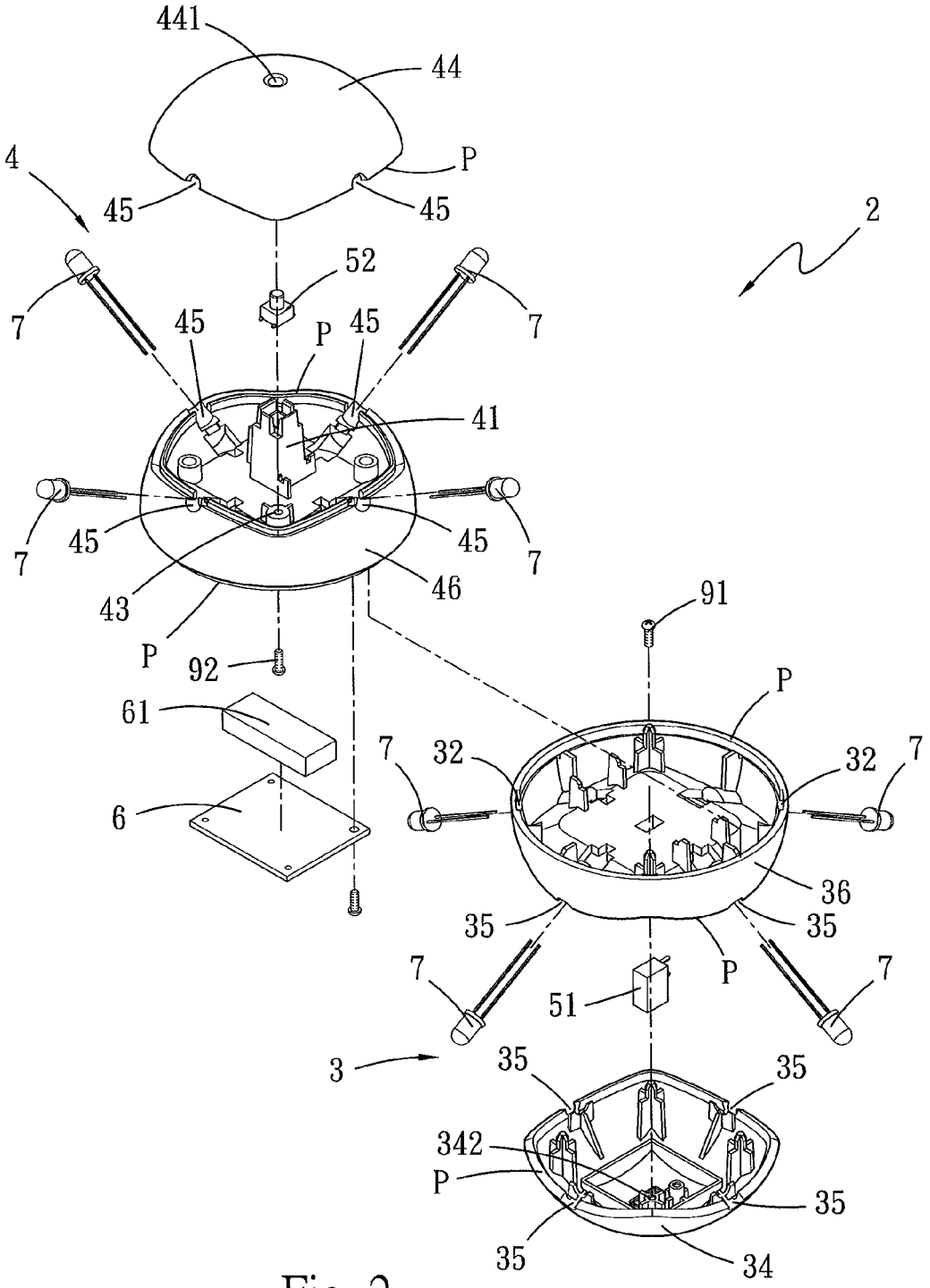
FIG. 2 is an exploded view of the LED lighting ball structure of the invention viewed from the bottom.
Figure 3A:
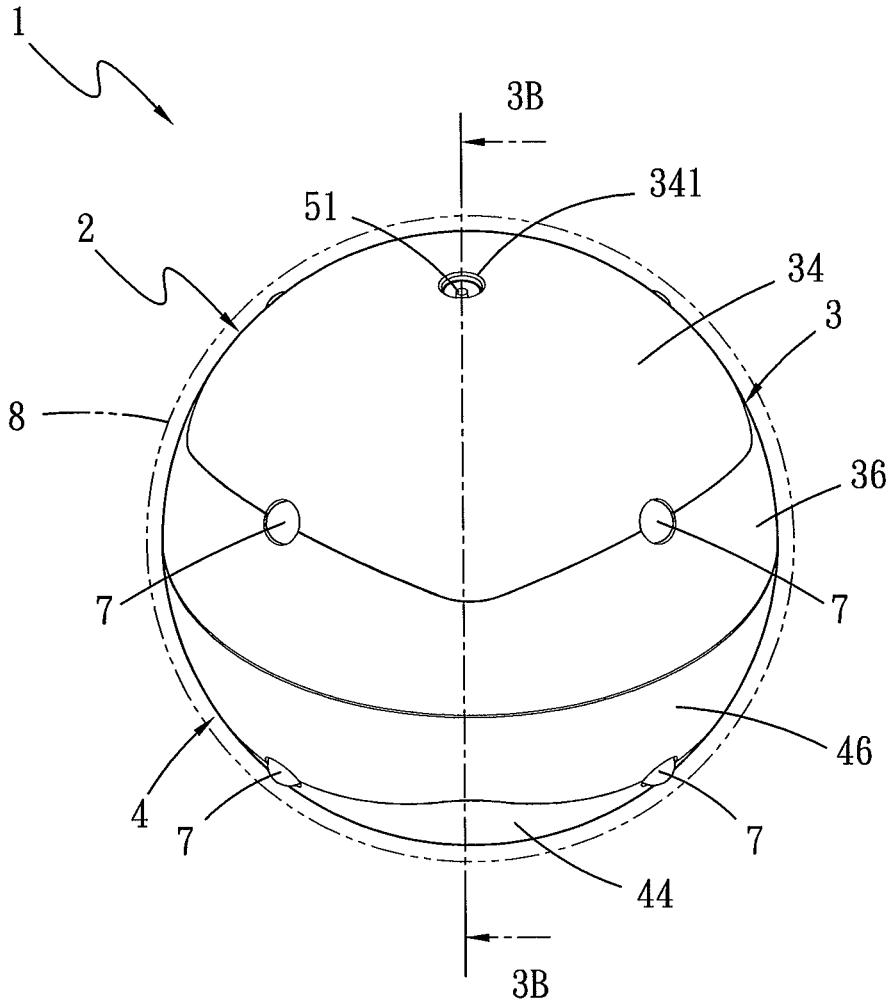
FIG. 3A is a perspective view of the LED lighting ball structure of the invention at an assembled condition.
Figure 3B:
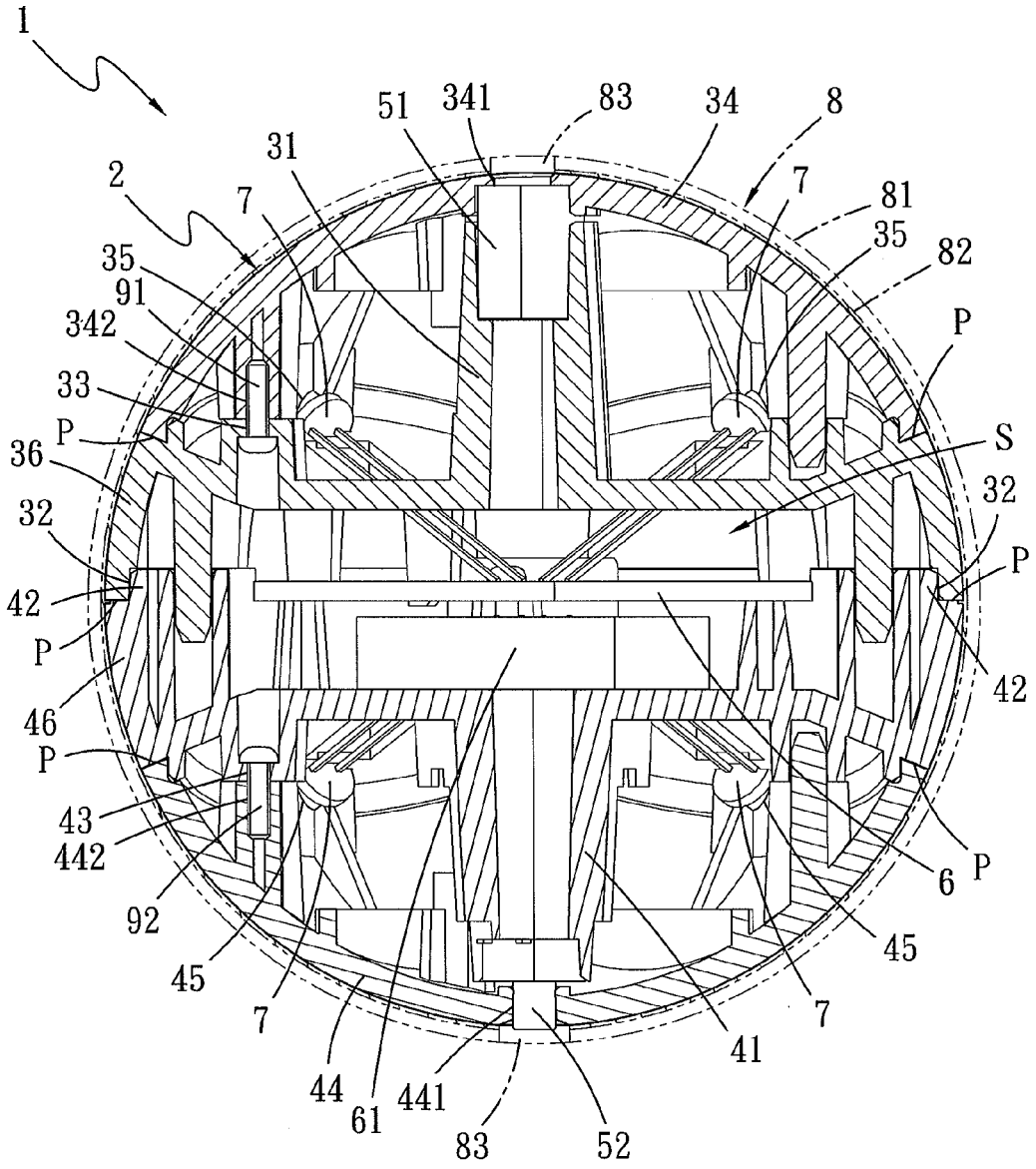
FIG. 3B is a cross section view taken on line 3B-3B in FIG. 3A.
Figure 4:
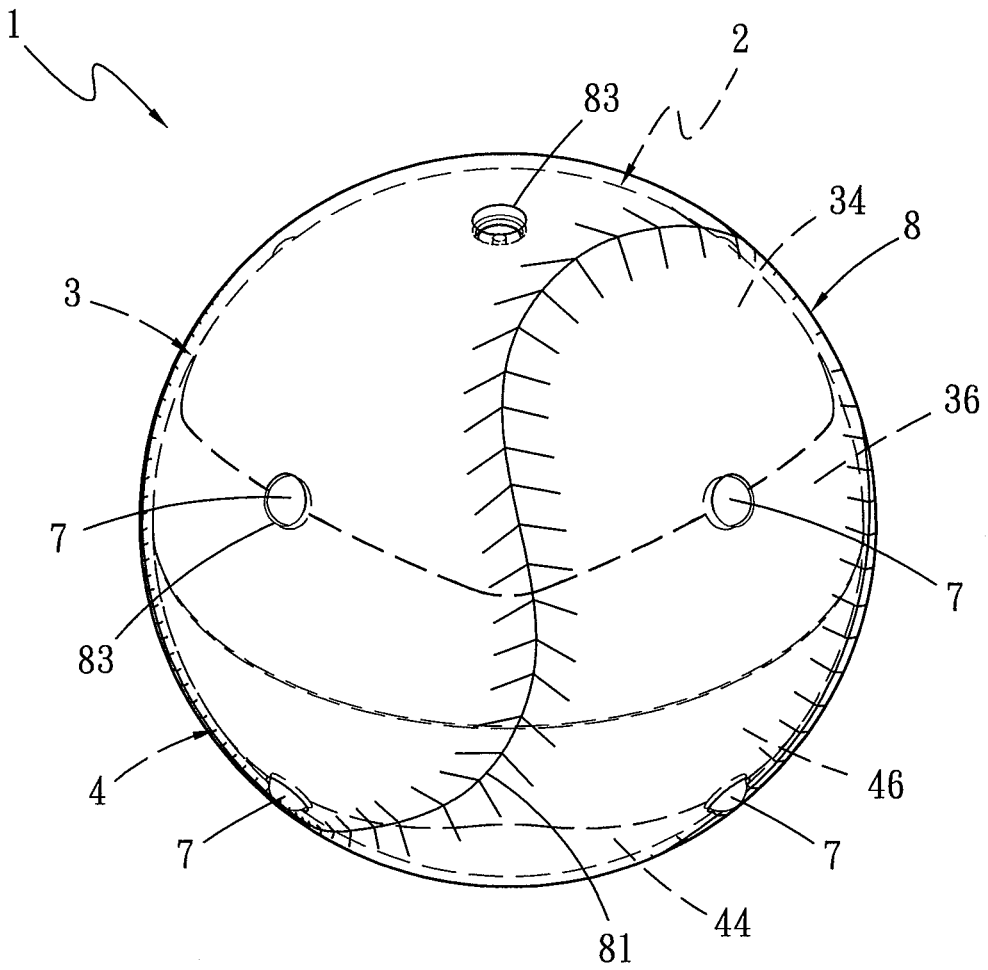
FIG. 4 is a perspective view of an embodiment of the LED lighting ball of the invention.

Please referring to FIGS. 1 through 4, the present invention aims to provide a LED lighting ball structure 1 which includes a spherical shell 2, a control unit 6 and a plurality of LED lighting units 7. The LED lighting ball structure 1 can serve as a memento signature ball of sport events.

More specifically, the spherical shell 2 includes a first segment 3 and a second segment 4 coupled with the first segment 3 to jointly define a housing space S. The first segment 3 has a first housing portion 36 and a first decorative cover plate 34 coupled with the first housing portion 36. The first housing portion 36 has a plurality of first assembly holes 35 communicating with the housing space S. Correspondingly, the second segment 4 has a second housing portion 46 and a second decorative cover plate 44 coupled with the second housing portion 46. The second housing portion 46 has a plurality of second assembly holes 45 communicating with the housing space S. In this embodiment, the first segment 3 and the second segment 4 are formed respectively in a semispherical profile. The first housing portion 36 has two latch grooves 32 formed on the circumference P of another side opposite to the first decorative cover plate 34. The second housing portion 46 has two latch portions 42 corresponding to the latch grooves 32 to allow the first housing portion 36 and the second housing portion 46 to be coupled together. Thus, through the latch grooves 32 and the latch portions 42 the first segment 3 and the second segment 4 can be coupled together to form the spherical shell 2.

The control unit 6 aims to electrically control lighting ON/OFF duration, flicker sequence, lighting colors and the like of the LED lighting units 7. In practice, the control unit 6 can be a control circuit or a programmable mono-chip, and is located in the housing space S and fastened to the second housing portion 46. However, the mounted location of the control unit 6 can be adjusted as required according to actual space layout, and also can be fastened to the first housing portion 36, and is not limited to the aforesaid approaches. In one embodiment, the LED lighting ball structure 1 further includes a power supply unit 61 located in the housing space S and formed electrical connection with the control unit 6.

The power supply unit 61 can be a chargeable battery and can be charged and used repeatedly, therefore can enhance the commercial value and environmental conservation concept of the LED lighting ball structure 1.

The LED lighting unit 7 is located in the first assembly holes 35 and the second assembly holes 45 respectively and electrically connected to the control unit 6.

In another embodiment of the invention, the LED lighting ball structure 1 further includes a connecting portion 51 located on the first segment 3 and connected to the control unit 6 to get power from an external power source for the control unit 6. The first decorative cover plate 34 has a first aperture 341 run through by the connecting portion 51. The LED lighting ball structure 1 further includes a switch element 52 located on the second segment 4 and connected to the control unit 6 to enable the control unit or control electrical modes of the control unit 6. The second decorative cover plate 44 has a second aperture 441 run through by the switch element 52.

Furthermore, the first housing portion 36 has a first protruding portion 31 extended towards the first decorative cover plate 34 to connect to the connecting portion 51 and a first through hole 33. The first decorative cover plate 34 has a first screw hole 342 corresponding to the first through hole 33 for a first fastener 91 such as a screw to penetrate through to fasten to the first through hole 33. The first fastener 91, the first through hole 33 and the first screw hole 342 can be screwed together to make the first aperture 341 to mate and couple with the connecting portion 51 for fastening. In addition, the second housing portion 46 has a second protruding portion 41 extended towards the second decorative cover plate 44 to connect to the switch element 52 and a second through hole 43. The second decorative cover plate 44 has a second screw hole 442 corresponding to the second through hole 43 for a second fastener 92 such as screw to penetrate through to fasten to the second through hole 43. The second fastener 92, the second through hole 43 and the second screw hole 442 can be screwed together to make the second aperture 441 to mate and couple with the switch element 52 for fastening.

In another embodiment of the invention the LED lighting ball structure 1 further includes a coating layer 8 to cover the surface of the spherical shell 2.

The coating layer 8 can be leather, tennis ball skin or sticking paper. The coating layer 8 has an adhesive layer 82 bonded to the surface of the spherical shell 2 and a decorative layer 81 located on one side of the adhesive layer 82 remote from the surface of the spherical shell 2. The coating layer 8 also has a plurality of holes 83 corresponding to each of the LED lighting units 7, the connecting portion 51 and the switch element 52 to allow the LED lighting units 7, the connecting portion 51 and the switch element 52 to be exposed outside the LED lighting ball structure 1.

Figure 5:
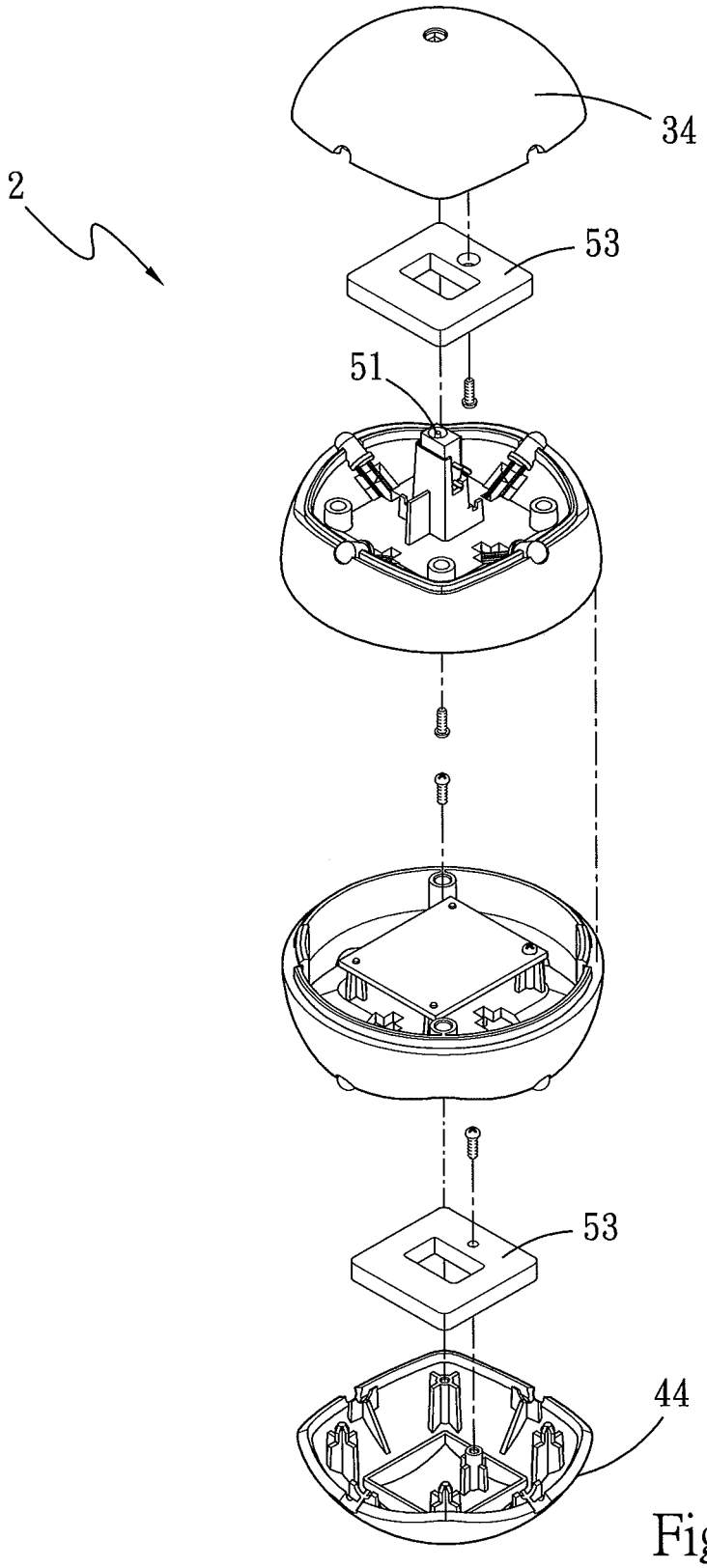
FIG. 5 is an exploded view of the invention included counterweight members.
Figure 6:
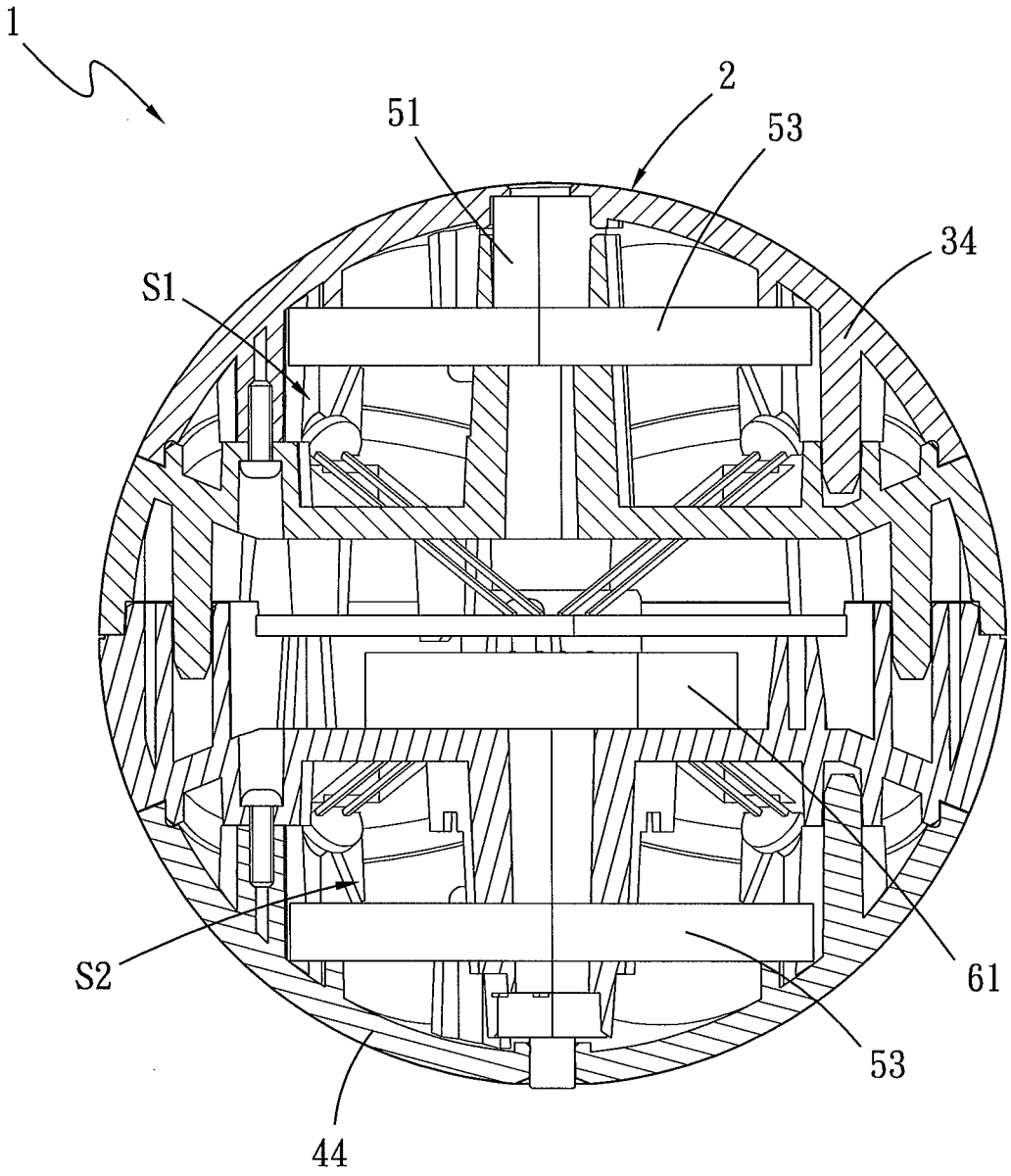
FIG. 6 is a sectional view of FIG. 5.

Also referring to FIGS. 5 and 6, the first segment 3 includes a first counterweight space S1 jointly defined by the first housing portion 36 and the first decorative cover plate 34, and the second segment 4 includes a second counterweight space S2 jointly defined by the second housing portion 46 and the second decorative cover plate 44. The LED lighting ball structure 1 further includes a plurality of counterweight members 53 located respectively in the first counterweight space S1 and the second counterweight space S2. The counterweight members 53 are fastened respectively to the first housing portion 36 and the second housing portion 46 to increase the loading weight of the LED lighting ball structure 1 to make the LED lighting ball structure 1 look more like a real thing to improve the authenticity thereof.

As a conclusion, the LED lighting ball structure 1 of the invention, through the control unit 6 to control flicker alteration of the LED lighting units 7, can enhance visual effect. The decorative layer 81 of the coating layer 8 is adaptable to varying styles to suit sales of the sport sites and players' signatures, such as a profile of a baseball, a tennis ball or the like, therefore can enhance the memento and collectible value of the LED lighting ball structure 1, and also increase collection and display desire of the fans, thereby can substitute the conventional solid core signature ball.

What is claimed is:

1. An LED lighting ball structure, comprising:

a spherical shell including a first segment and a second segment coupled with the first segment to jointly define a housing space, the first segment including a first housing portion and a first decorative cover plate coupled with the first housing portion, the first housing portion including a plurality of first assembly holes communicating with the housing space; the second segment including a second housing portion and a second decorative cover plate coupled with the second housing portion, the second housing portion including a plurality of second assembly holes communicating with the housing space;

a control unit located in the housing space; and a plurality of LED lighting units each being located respectively in the first assembly holes and the second assembly holes and formed electrical connection with the control unit.

2. The LED lighting ball structure of claim 1 further including a power supply unit located in the housing space and formed electrical connection with the control unit.

3. The LED lighting ball structure of claim 1 further including a connecting portion located on the first segment and connected to the control unit to receive power from an external power source to supply the control unit, the first decorative cover plate including a first aperture run through by the connecting portion.

4. The LED lighting ball structure of claim 1 further including a switch element located on the second segment and connected to the control unit to enable the control unit or control electrical modes of the control unit, the second decorative cover plate including a second aperture run through by the switch element.

5. The LED lighting ball structure of claim 1, wherein the first segment includes a first counterweight space jointly defined by the first housing portion and the first decorative cover plate, and the second segment includes a second counterweight space jointly defined by the second housing portion and the second decorative cover plate, and the LED lighting ball structure further includes a plurality of counterweight members located respectively in the first counterweight space and the second counterweight space.

6. The LED lighting ball structure of claim 1, wherein the first segment and the second segment are formed respectively in a semispherical shell profile.

7. The LED lighting ball structure of claim 1, wherein the first housing portion includes a first through hole and the first decorative cover plate includes a first screw hole corresponding to the first through hole for a first fastener to penetrate through to fasten to the first through hole, and the second housing portion includes a second through hole and the second decorative cover plate includes a second screw hole corresponding to the second through hole for a second fastener to penetrate through to fasten to the second through hole.

8. The LED lighting ball structure of claim 1 further including at least one coating layer to cover a surface of the spherical shell.

9. The LED lighting ball structure of claim 8, wherein the coating layer includes a plurality of holes corresponding to each of the LED lighting units.

10. The LED lighting ball structure of claim 8, wherein the coating layer includes an adhesive layer bonded to the surface of the spherical shell and a decorative layer located on one side of the adhesive layer remote from the surface of the spherical shell.

* * * * *